US009161595B2

(12) United States Patent
Riemer

(10) Patent No.: US 9,161,595 B2
(45) Date of Patent: Oct. 20, 2015

(54) WALKING CANE

(71) Applicant: Nikolai B. Riemer, Temple, TX (US)

(72) Inventor: Nikolai B. Riemer, Temple, TX (US)

( * ) Notice: Subject to any disclaimer, the term of this patent is extended or adjusted under 35 U.S.C. 154(b) by 0 days.

(21) Appl. No.: 13/904,898

(22) Filed: May 29, 2013

(65) Prior Publication Data

US 2014/0261590 A1 Sep. 18, 2014

Related U.S. Application Data

(60) Provisional application No. 61/788,925, filed on Mar. 15, 2013.

(51) Int. Cl.

| | |
|---|---|
| ***A45B 3/04*** | (2006.01) |
| ***A61H 3/02*** | (2006.01) |
| ***A45B 3/00*** | (2006.01) |
| ***A45B 9/02*** | (2006.01) |
| ***A45B 9/04*** | (2006.01) |
| ***E01H 1/12*** | (2006.01) |
| *A45B 9/00* | (2006.01) |

(52) U.S. Cl.

CPC ... *A45B 3/04* (2013.01); *A45B 3/00* (2013.01); *A45B 9/02* (2013.01); *A45B 9/04* (2013.01); *E01H 1/1206* (2013.01); *A45B 2009/007* (2013.01); *A61H 2003/0222* (2013.01); *A61H 2201/0188* (2013.01); *A61H 2201/0192* (2013.01); *E01H 2001/1293* (2013.01)

(58) Field of Classification Search

CPC ..... A45B 3/02; A45B 3/04; A61H 2003/0222
USPC ..... 135/66, 910; 362/102
See application file for complete search history.

(56) References Cited

U.S. PATENT DOCUMENTS

| | | | | |
|---|---|---|---|---|
| 1,595,023 | A * | 8/1926 | Probe | 362/102 |
| 2,245,349 | A | 7/1939 | Lombardi | |
| 4,711,482 | A | 12/1987 | Brown et al. | |
| D333,075 | S | 2/1993 | Incantalupo et al. | |
| 5,392,800 | A * | 2/1995 | Sergi | 135/65 |
| 5,588,735 | A | 12/1996 | Harada | |
| 5,636,650 | A * | 6/1997 | Kroeze | 135/66 |
| 5,640,985 | A | 6/1997 | Snyder et al. | |
| 5,810,466 | A * | 9/1998 | Young | 362/102 |
| 6,386,216 | B1 * | 5/2002 | Cubelli | 135/66 |
| 6,394,116 | B1 * | 5/2002 | Winn et al. | 135/65 |
| 6,840,557 | B1 | 1/2005 | Manthey | |
| 7,377,662 | B1 * | 5/2008 | Bernstein et al. | 362/102 |
| 7,624,746 | B2 | 12/2009 | Blake | |
| 2006/0090783 | A1 * | 5/2006 | King-Fai | 135/67 |
| 2006/0266397 | A1 * | 11/2006 | Berl | 135/70 |
| 2008/0251109 | A1 * | 10/2008 | Lee | 135/66 |
| 2010/0043853 | A1 * | 2/2010 | Wu | 135/66 |
| 2011/0155195 | A1 | 6/2011 | Martin | |

* cited by examiner

*Primary Examiner* — David R Dunn
*Assistant Examiner* — Danielle Jackson
(74) *Attorney, Agent, or Firm* — Matthew E. Burr

(57) ABSTRACT

An adjustable-length walking aid provides a hollow tubular body having a top and a bottom. A spring-biased gripper arm at the bottom is connected to a tension gripper actuator filament that is spooled around a flywheel spool. A lamp housed in the base of the body is connected to a power supply in the handle by a conductive filament that is also spooled around the flywheel. The tension on the gripper actuator and conductive filaments is maintained by the flywheel regardless of the length to which the cane is adjusted.

9 Claims, 16 Drawing Sheets

WALKING CANE

CROSS-REFERENCE TO RELATED APPLICATIONS

This disclosure is related to, claims priority from, and the benefit of, U.S. provisional patent application Ser. No. 61/788,925, entitled Walking Cane and Methods of Use Thereof, filed Mar. 15, 2013, by the same inventor, the disclosure of which is incorporated herein by reference.

FIELD OF THE DISCLOSURE

This disclosure relates generally to walking canes and more particularly to a height-adjustable walking cane that provides a gripper arm and downward and forward facing lights.

BACKGROUND

Implements to assist with walking are well known and often take the form of a cane with a handle at the top and skid-resistant cap at the bottom. Canes are useful to assist locomotion for those who, do to age or injury, for example, require or appreciate the stability that a cane provides for upright walking. As the baby boom generation ages, walking canes become increasingly important personal possessions.

In addition to mobility, the elderly may also appreciate help tools that help them pick and retrieve items. Walking canes that incorporate a gripper mechanism have been described previously, such as in U.S. Pat. No. 7,624,746, where a gripper mechanism for an adjustable length cane is operated by a cabling system house internally in the hollow cane.

Height-adjustable walking canes with a gripper mechanism and a light that can be switched on and off by the user have also been described, such as, for example, US Pat. Pub. No. US20110155195.

Despite the clever solutions provided in the above references, they have shortcomings. For example, a light at the base of the cane and an actuator mechanism near the handle is not provided for an adjustable-height cane, because they do not provide an adjustable length electrical conductor that maintains its tension when the length of the cane is changed.

Another shortcoming is the lack of selectively actuatable illumination sources that project light in more than one desired direction. For example, it would be useful to have a light that shines forward to illuminate the area into which a user is walking, as well as a light that shines downward or from the base of the cane, to illuminate the floor or under a table or chair so that a user can find something that may have fallen on the floor or under a table.

The present disclosure, accordingly, describes an adjustable-length walking cane with a gripper mechanism and more than one source of illumination.

SUMMARY

An adjustable-length walking aid provides a hollow tubular body having a top and a bottom. A spring-biased gripper arm at the bottom is connected to a tension filament that is spooled around a flywheel spool such that the tension on the tension filament is maintained by the flywheel regardless of the length to which the cane is adjusted.

Selectively actuated illumination sources connected to a power source, one source at the top that illuminates forward and one the at the bottom that illuminates downward at the base portion are connected to an a conducting electrical filament that is spooled around another flywheel spool such that the tension on the electrical filament is maintained by the flywheel regardless of the length to which the cane is adjusted.

Additional features include without limitation a handle at the top and mounted to the handle is a gripper arm trigger connected to the gripper arm by the tension cable to selectively open and close the gripper arm. At least one power source connected to the front and bottom illumination sources cooperates with one or more controls connected to the power source to selectively actuate the front and base illumination sources independently.

The gripper arm tension cable (also called a filament) and the electrical conducting cable (or filament) are both organized on a double spool sprocket flywheel assembly mounted, preferably internally, to the cane body. A selectively actuated flywheel lock selectively locks or releases the tension cable around the second spool to open the gripper arm.

BRIEF DESCRIPTION OF THE DRAWINGS

For a more complete understanding of the present disclosure, and the advantages thereof, reference is now made to the following descriptions taken in conjunction with the accompanying drawings, in which:

FIG. 4B is side view cut away diagrammatic illustration of a detail of the gripper arm mounting assembly of a cane of the present disclosure.

DETAILED DESCRIPTION

Figures 1A, 1B, 1C:
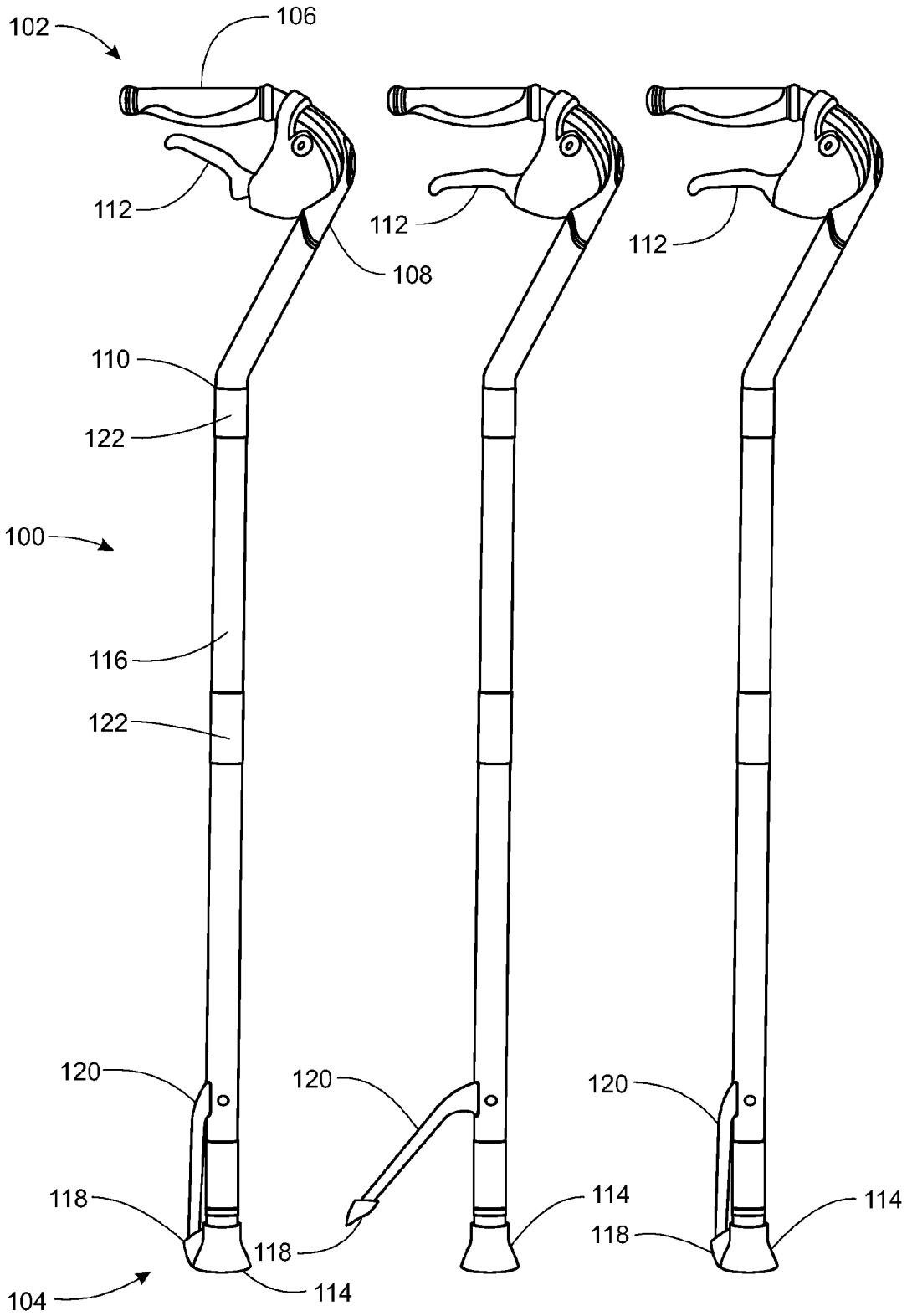
FIG. 1A is a side view diagrammatic illustration of a cane of the present disclosure having the gripper arm in a closed position.
FIG. 1B is a side view diagrammatic illustration of a cane of the present disclosure having the gripper arm in a retracted position.
FIG. 1C is a side view diagrammatic illustration of a cane of the present disclosure having the gripper arm in a locked position for walking.

Referring to FIGS. 1A-1C of the drawings, the reference numeral 100 generally designates a waking cane embodying features of the present disclosure. The system 100 includes a walking cane with a gripper arm and a trigger handle with which to operate the gripper arm, together with a source of illumination located at the top and bottom of the cane, each of which sources of illumination is selectively operable by a user. The height of the cane is adjustable for the comfort of the user, and the internal workings of the cane provide mechanisms for mechanical and electrical conduits of adjustable length to accommodate the user-selected height.

FIG. 1A is a side view diagrammatic illustration of a cane of the present disclosure having the gripper arm in a closed position. The top or handle end of the cane provides a handle, disposed more or less horizontally, to be held manually. The handle is mounted to, or formed contiguous with, a hollow tubular member 108 which tilts downward and extends forward for a distance then backward for a distance to descend roughly arcuate to a portion 110 where the tubular member straightens vertically and extends to bottom end 104. Mounted to or integral with the handle and arcuate portion near the top end, is a lever-type squeeze trigger 112. Bottom end 104 provides a skid-resistant base cap 114. Mounted to the vertical tubular member 116 is gripper arm 120. Skid-resistant gripper cap 118 mounted to the distal terminus 250 (see FIG. 2) of the gripper arm 120 facilitates the grasping of an object by gripper arm 120. Preferred alternative embodiments provide reflective strips 122 disposed on member 116 to enhance the visibility of the cane 100 in low illumination environmental conditions.

FIG. 1A illustrates a cane of the present disclosure in its full, closed, grasping configuration. Trigger 112 is in grasping position proximate to handle 106 and gripper arm 120 is flush against base cap 114.

FIG. 1B is a side view diagrammatic illustration of a cane of the present disclosure having the gripper arm in a retracted position. Trigger 112 is in retracted position distal from handle 106 and gripper arm 120 is extended pivotally distal from base cap 114.

FIG. 1C is a side view diagrammatic illustration of a cane of the present disclosure having the gripper arm in a locked position for walking. Trigger 112 is in retracted position distal from handle 106 and gripper arm 120 is flush against terminus member, base cap 114.

Figure 2:
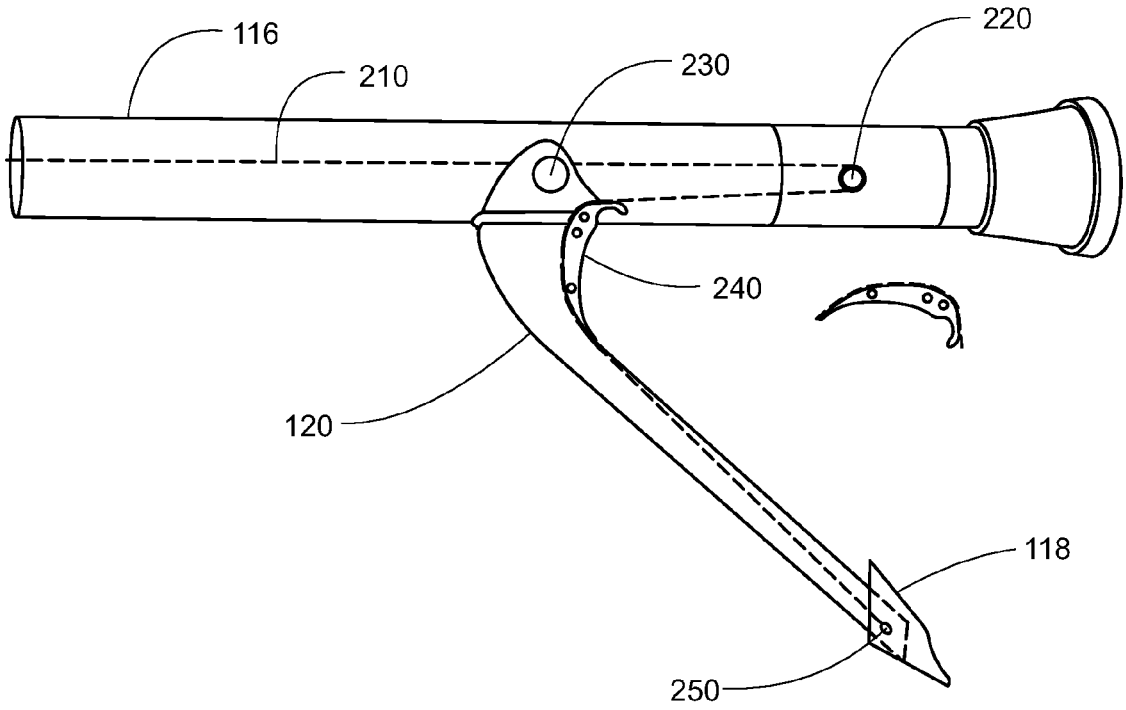
FIG. 2 is a side view cut away detail of a cane gripper rod assembly of the present disclosure.

FIG. 2 is a side view cut away detail of a cane gripper rod assembly of the present disclosure. Cable 210 is positioned within hollow tubular 116 and connected internally to hollow gripper arm 120. Cable 210 is actuated by trigger 112. Cable pin 220 is positioned transversely within hollow tubular member 116 below the pivot attachment point 230 of the gripper arm 120 to tubular member 116, proximate to gripper cap 118. Cable 210 is disposed under cable pin 220, over guide member 240, and attached internally to gripper arm at terminus 250.

Figures 3A, 3B, 3C, 3D:
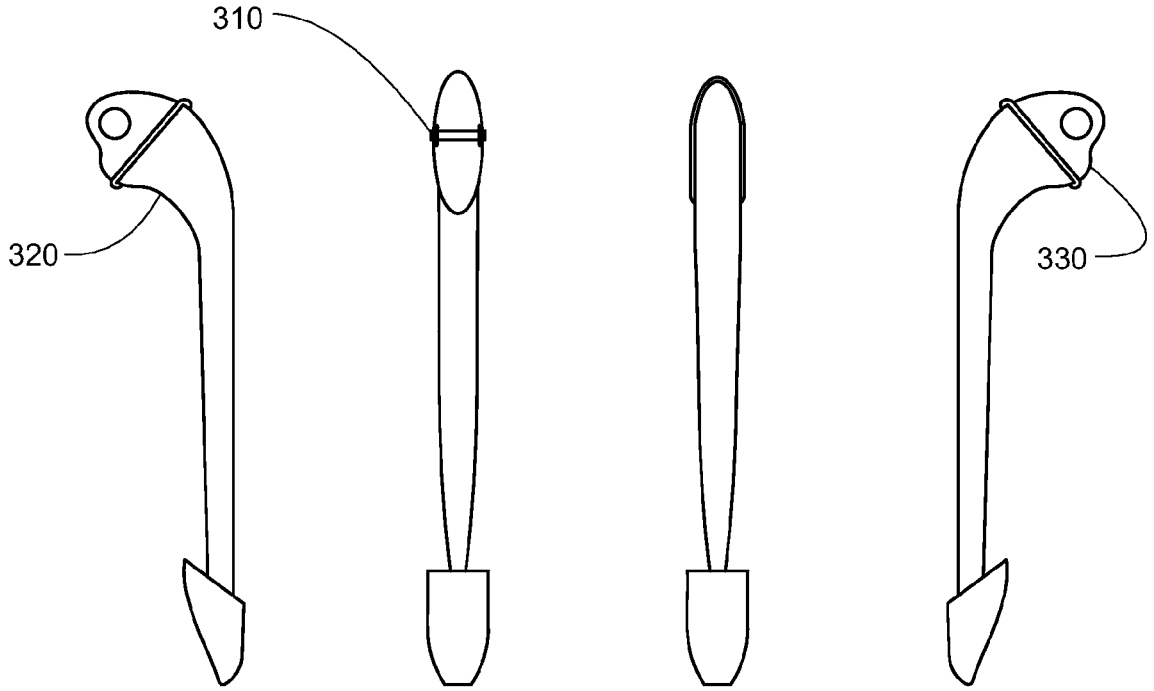
FIG. 3A is a proximate side view of a gripper arm of FIG. 2.
FIG. 3B is a proximate side view of a gripper arm of FIG. 2.
FIG. 3C is a back view of a gripper arm of FIG. 2.
FIG. 3D is a distal side view of a gripper arm of FIG. 2.

FIGS. 3A-3D illustrate a gripper arm of a cane of the present disclosure. FIG. 3A shows gripper arm 120 in proximate side view. FIG. 3B shows gripper arm 120 in front view. FIG. 3C shows gripper arm 120 in back view. Gripper arm 120 is pivotally mounted to pivot rod 310 which is disposed transversely across mounting portion 320. FIG. 3D shows gripper arm 120 in distal side view. Housing 330 provides reinforcement of mounting portion 320.

Figure 4A:
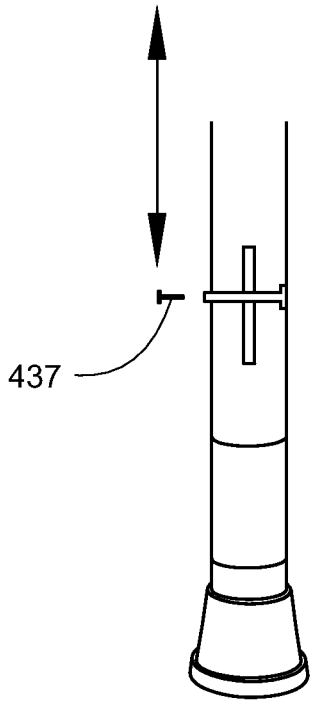
FIGS. 4A and 4B is a front view cut away diagrammatic illustration of a detail of the gripper arm mounting assembly of a cane of the present disclosure.
Figure 4B:
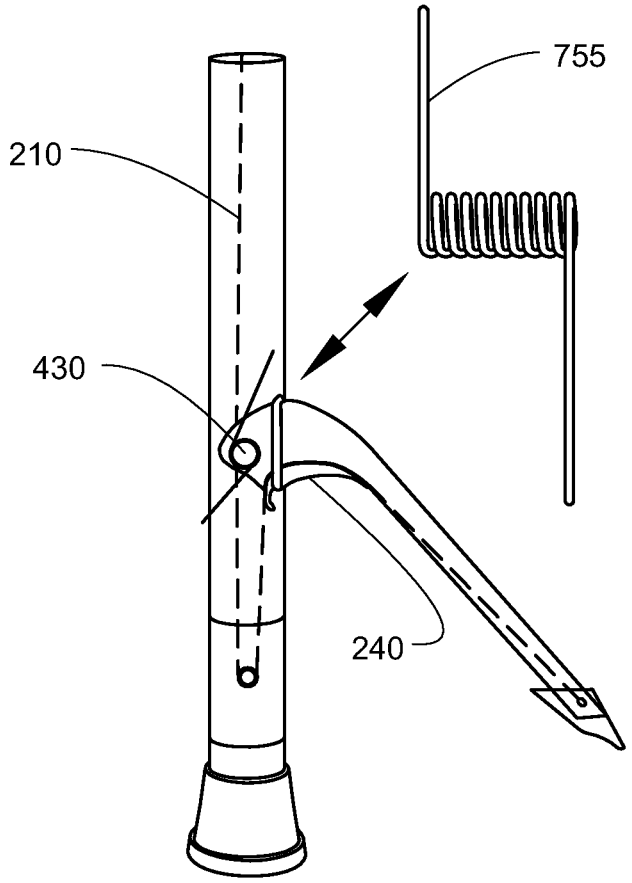

FIGS. 4A and 4B are cut away diagrammatic illustrations of a detail of the gripper arm mounting assembly of a cane of the present disclosure. Gripper arm 120 is mounted with a spring bias by virtue of spring 430 disposed in hollow tubular member 116. Pin 437 secures spring 430 in position.

Figure 5A:
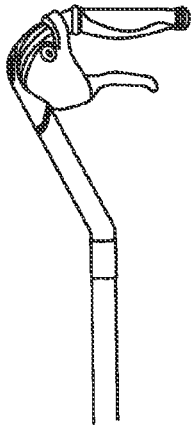
FIG. 5A is a side view of the upper portion of a cane of the present disclosure.
Figure 5B:
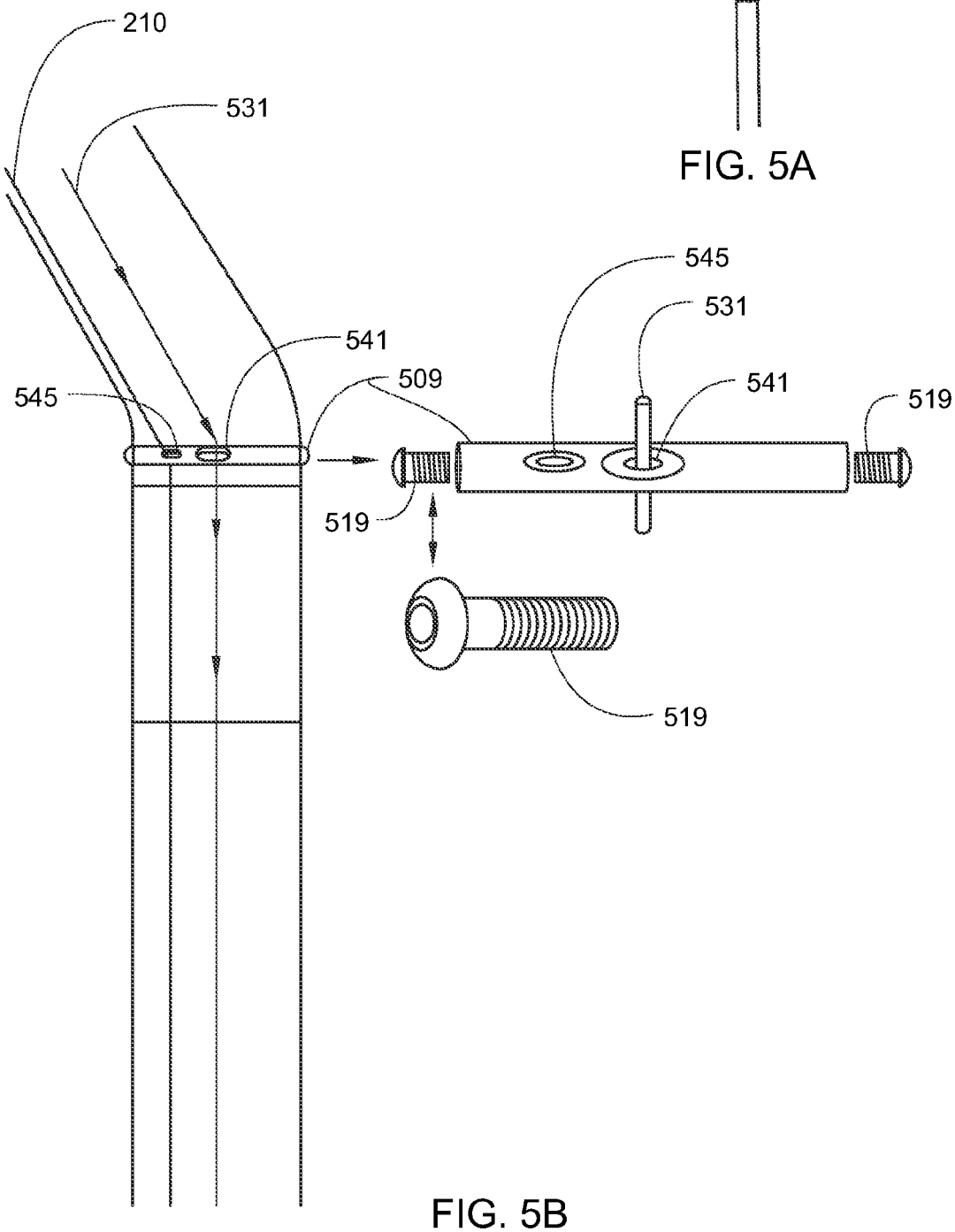
FIG. 5B is a cut away side view of a detail of FIG. 5A.

FIG. 5A is a side view of the upper portion of a cane of the present disclosure. FIG. 5B is a cut away side view of a detail of FIG. 5A. In particular, FIG. 5B illustrates the cable and electrical wire alignment assembly of a cane of the present disclosure. Gripper actuator cable 210, and the electrical wire 531 to power the base light, extend along the interior of the cane's body tube from trigger 112 to base cap 114, and negotiate a change in direction where the arcuate upper portion of the tube curves to transition to a vertical portion of the tube. To facilitate the change in direction, alignment assembly rod 509 is provided to guide the electrical and mechanical filaments. Rod 509 is mounted in the interior of tube 116 and secured in position with bolts 519. Electrical power wire 531 and gripper actuator cable 210 are threaded through guide holes 541, 545, respectively.

Figure 5C:
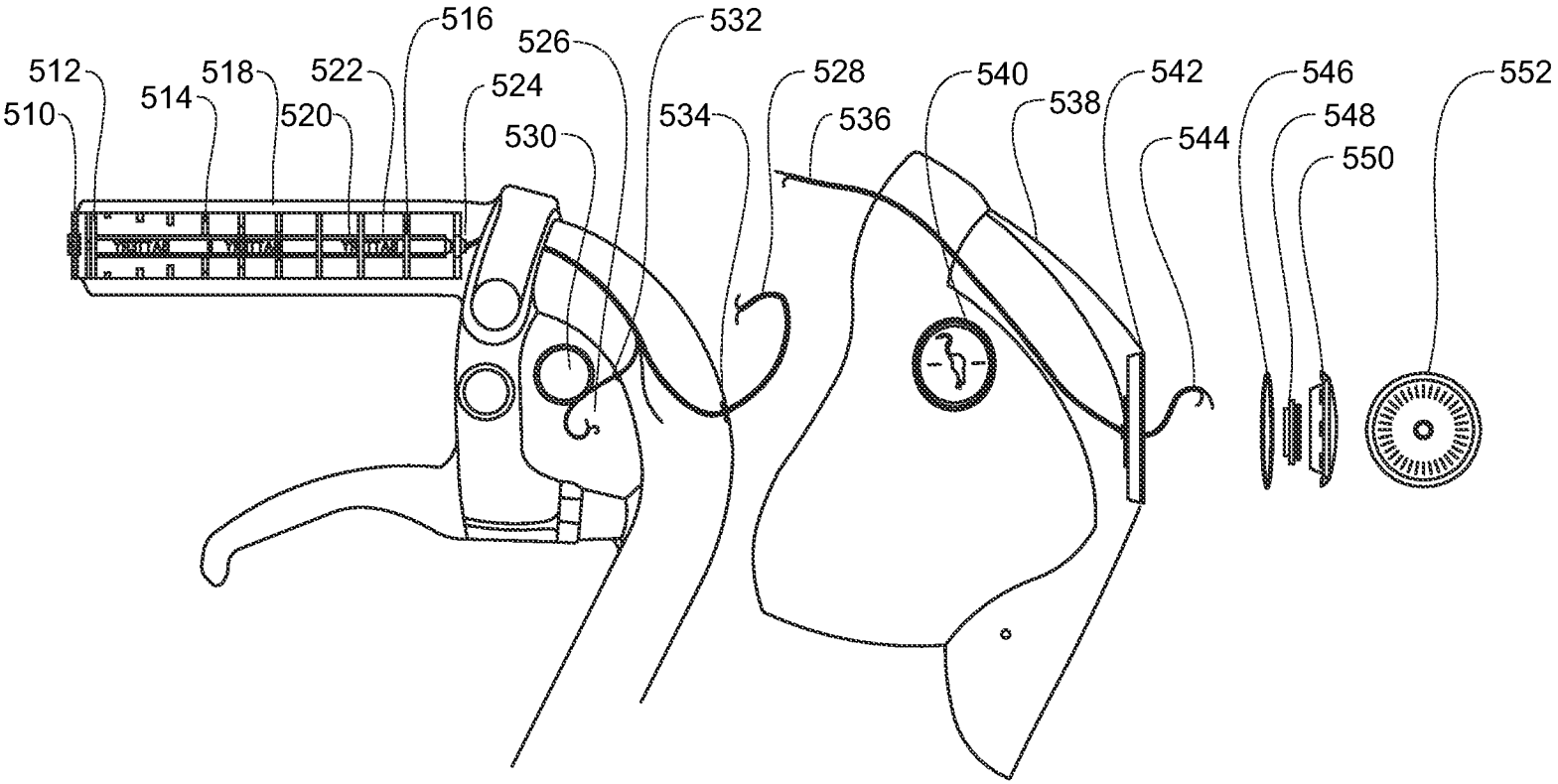
FIG. 5C is a cut away exploded view diagrammatic illustration of the light assembly power supply and frame housing attachment of a cane of the present disclosure.

FIG. 5C is a cut away exploded view diagrammatic illustration of the light assembly power supply and frame housing attachment of a cane of the present disclosure. End cap 510 is mounted to threaded end cap 512 and provides a hand string insert hole for an optional attachment piece. Threaded end cap 512 screws into the proximal end of handle 106 to conceal the compartment for the battery or other power source, preferably with a water-tight seal. Interior battery tray insert 514 provides a plurality of internal rib protrusions 516 which annularly line the interior side of the handle's tubular wall for secure fit of the battery and to reduce the weight of the upper portion of the cane frame. Ribs 516 may, depending on engineering design choice, be formed integrally with the handle or mounted as pieces with a suitable adhesive, for example. Handle grip 518 is mounted on the tubular frame of the cane for a comfortable hand grip. Battery pack insert tube 520 holds batteries or other power supply which provide power to the lights. For example, the battery pack insert tube 520 preferably holds 3 AAA alkaline batteries. The ribs 516 from battery tray insert 514 hold the batteries securely in position. Battery insert tray tube 522 accommodates battery tray insert 514. Seal 524 provides a protective seal between the battery chamber and the rest of the cane frame, and secures the main electrical lead. The main electrical lead splits into power supply lead wire 526, which is connected to the lighting on/off switch, and head lamp electrical wire 528. Power switch housing tray 530 is discussed below.

Wire loom seal 532 is mounted around an aperture to protect wire lead 526 where it traverses out of the cane frame to connect to the lighting on/off switch. Wire loom rubber seal 534 is mounted around an aperture through which head lamp wire 528 traverses to protect the wire. Headlamp wire 536 is a continuation of headlamp wire 528, extending from the handle to the headlamp assembly in the headlamp housing 538, which provide headlamp on/off switch 540. Wire 536 continues through headlamp ring 542, which is mounted inside the handle bar cover plate to which the lamp assembly connects. Some slack 544 in the length of wire 536 is provided. Electrical wire 531 extends from power supply housed in battery pack insert tube 520 to base lamp assembly 610.

Washer 546 provides a protective seal around lamp 548 mounted in housing 550. In a preferred exemplary embodiment, housing 550 is an aluminum bell housing equipped with reverse alignment clips which attached to ring 542 and a durable glass face place. Headlamp housing 550 is shown in front view 552.

Figure 5D:
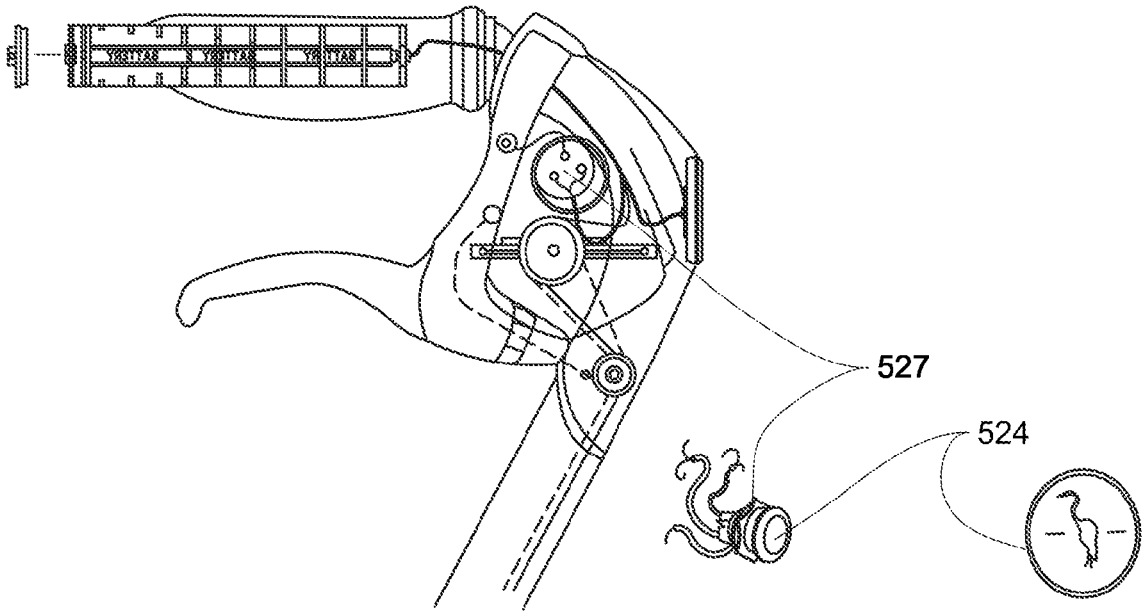
FIG. 5D is a side view cut away partial exploded illustration of a power switch detail of the top lamp assembly of FIG. 5C.

Turning now to FIG. 5D, is a side view cut away partial exploded illustration of the power switch detail of the top lamp of FIG. 5C. Power switch cover 524 is mounted on power switch assembly 527 which in turn is connected at power switch housing tray 530 to the power supply housed in battery pack insert tube 520 via wires 528/536.

Figure 5E:
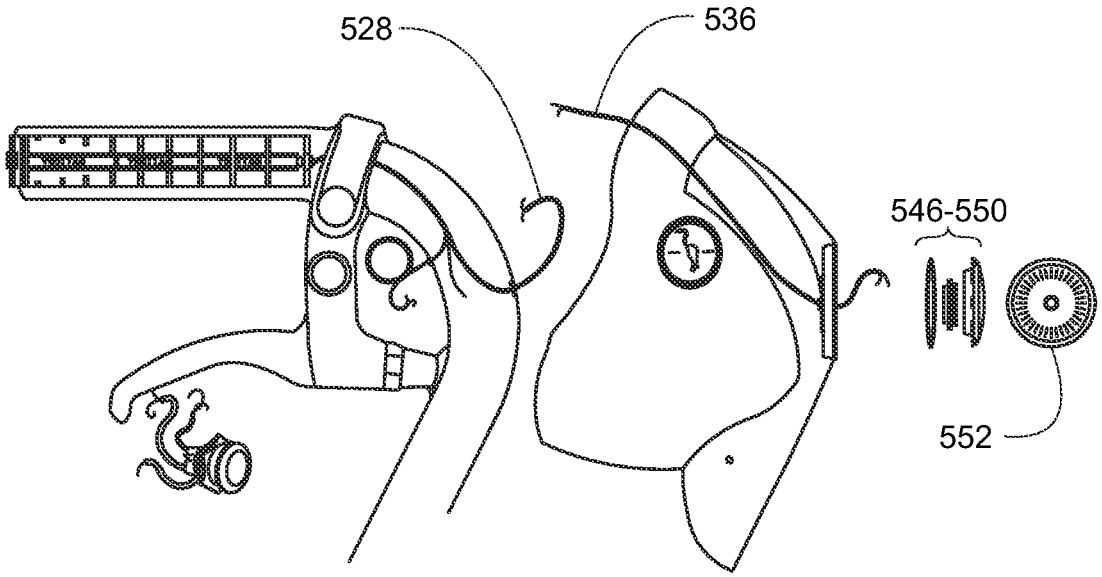
FIG. 5E is a side view partially exploded illustration of the top lamp assembly of FIG. 5A.

FIG. 5E is a side view partially exploded illustration of the top lamp assembly of FIG. 5A and depicts assembled light assembly with lead wires 528, 536.

Figure 5F:
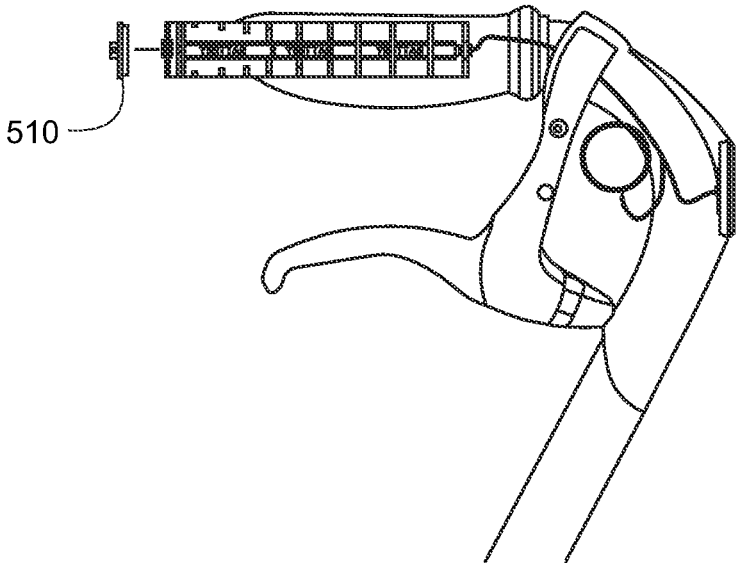
FIG. 5F is a non-exploded view of the assembly of FIG. 5E.

FIG. 5F is a non-exploded view of FIG. 5E, with the exception of depicting end cap 510 exploded from handle 106.

Figure 6A:
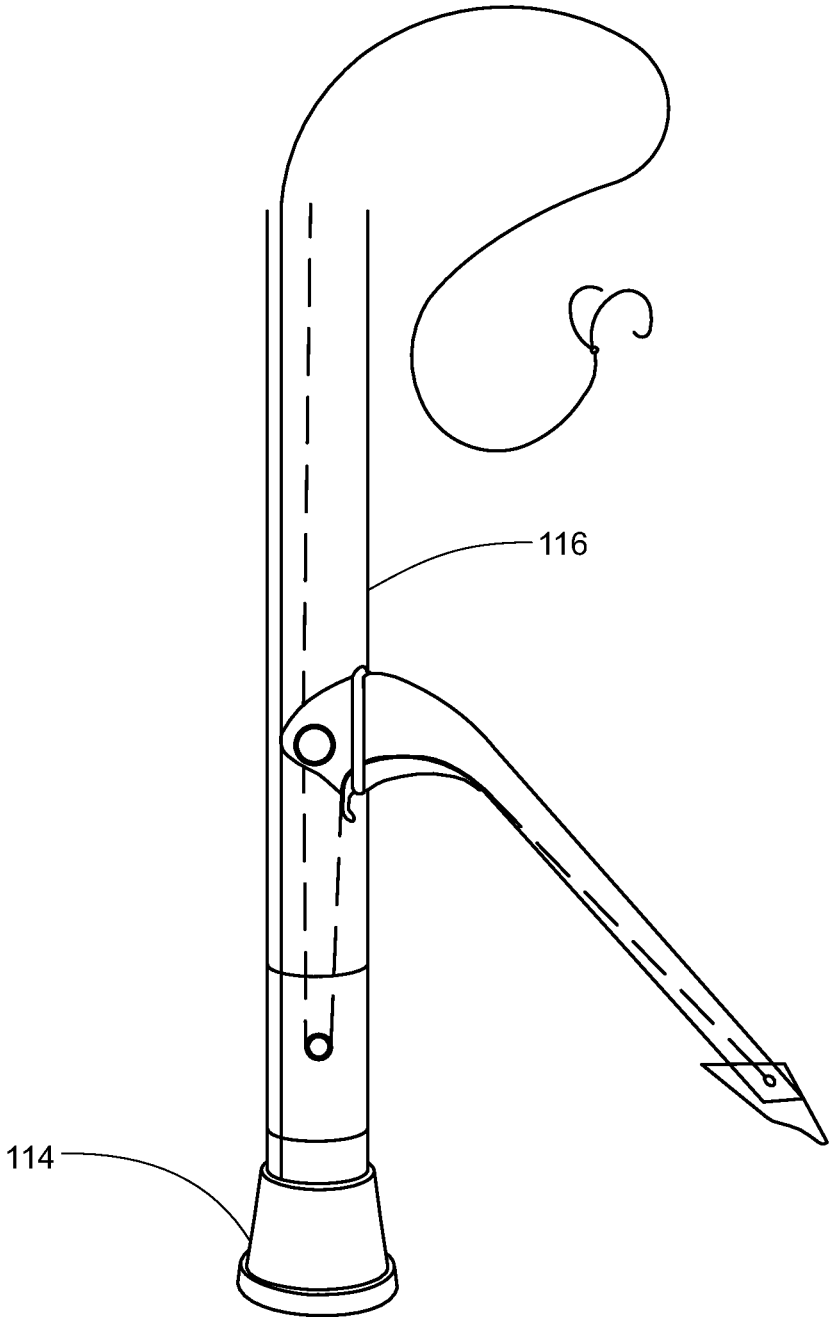
FIG. 6A is a side view cross section of the lower portion of a cane of the present disclosure.
Figure 6B:
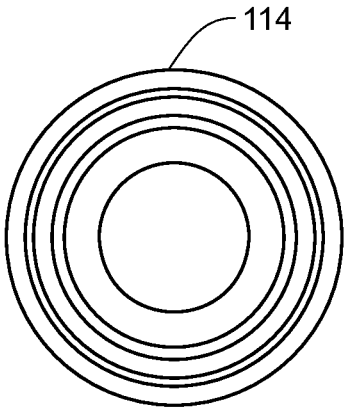
FIG. 6B is a diagrammatic illustration of a bottom view of the base of a cane of the present disclosure.
Figure 6C:
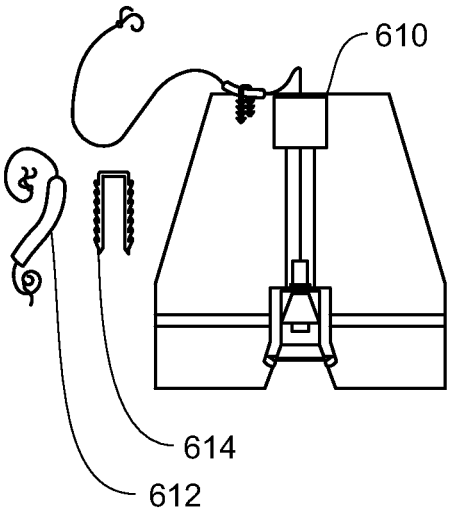
FIG. 6C is a side view cross section of the base of FIG. 6B.
Figure 6D:
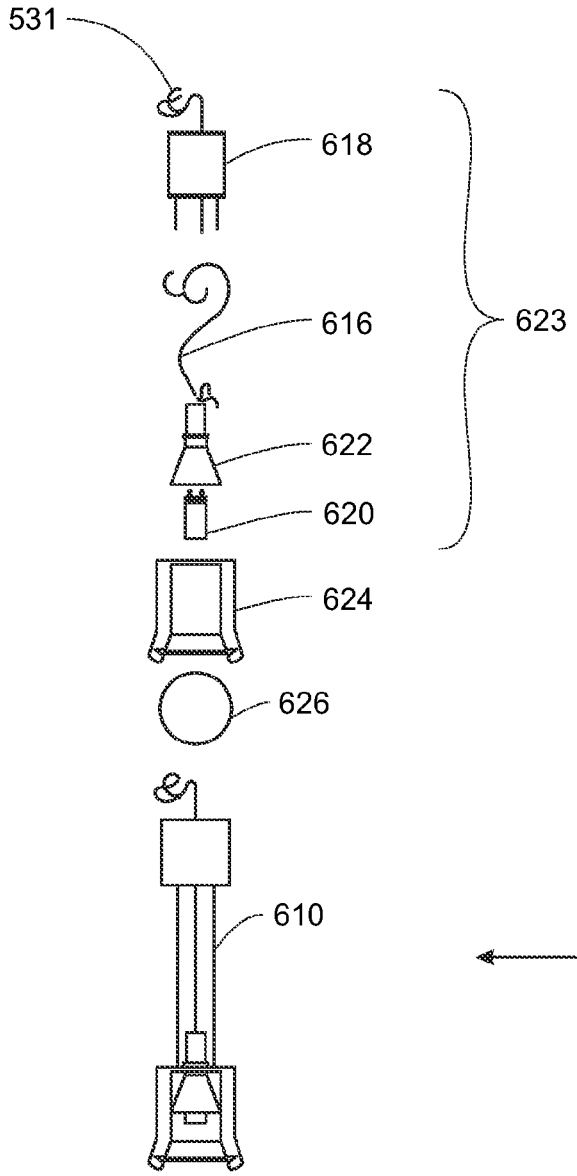
FIG. 6D is a translucent view of lamp assembly 610.

Turning now to the base lamp assembly, FIG. 6A is a side view cross section of the lower portion of a cane of the present disclosure. Cane body vertical portion 116 provides base 104 which houses a light assembly. FIG. 6B is a diagrammatic illustration of a bottom view of the base of a cane of the present disclosure. FIG. 6C is a side view cross section of the base of FIG. 6B. Lamp assembly 610 is mounted in the interior of the cane frame and protected by the base cap 114. Base light wire 612 is secured into position with clip 614 and is protected with a flexible tubular cover. FIG. 6D is an exploded view of the lamp assembly 610 of FIG. 6C. Electrical wire 616 passes through base lamp assembly cap 618 to light bulb 620 which is mounted in light bulb housing 622. The base lamp electrical assembly 623 is mounted inside housing 624, which provides protective glass cover 626.

Figure 6E:
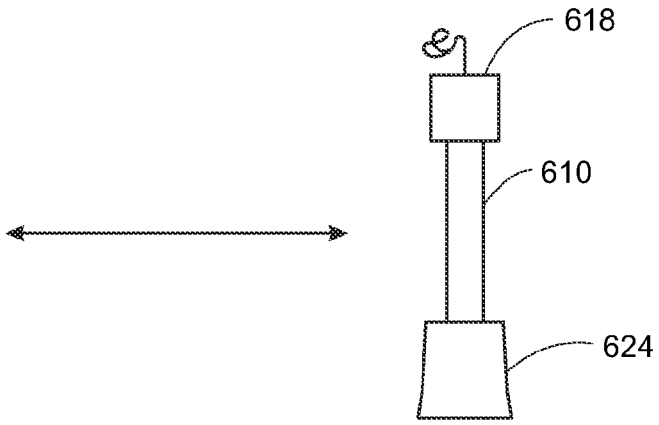
FIG. 6E is an opaque side view diagrammatic illustration of the base light assembly.

FIG. 6D is a translucent view of lamp assembly 610. FIG. 6E is an opaque side view diagrammatic illustration of the base light assembly.

Figure 7A:
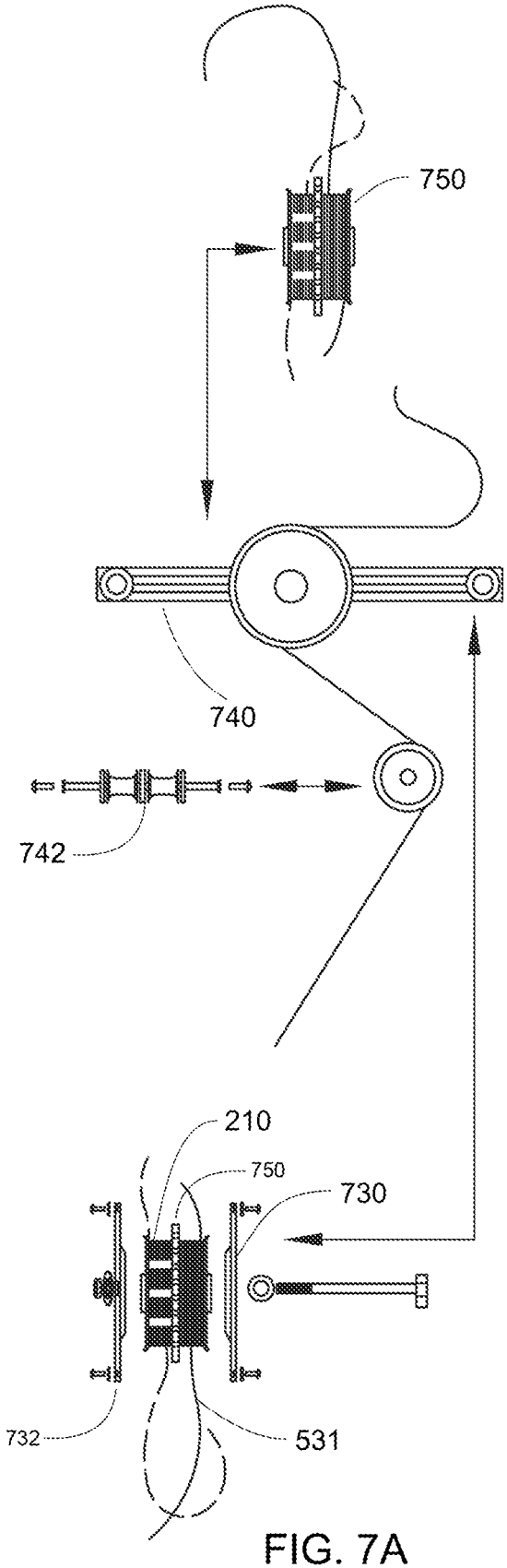
FIG. 7A is a diagrammatic illustration of an exploded side view of a filament fly wheel of a cane of the present disclosure.
Figure 7B:
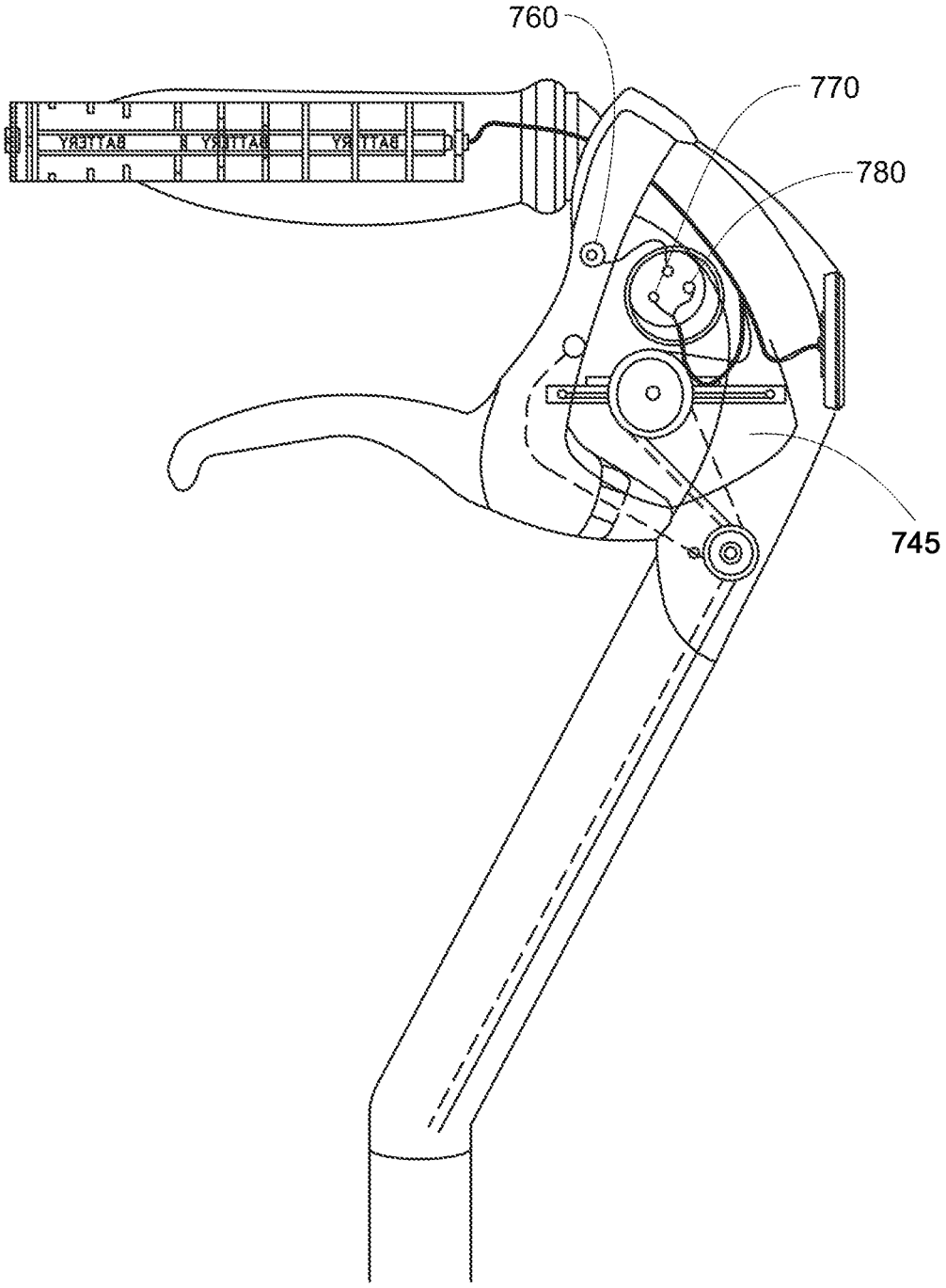
FIG. 7B is a translucent view illustration of the upper portion of a cane of the present disclosure.

FIG. 7A is a diagrammatic illustration of an exploded side view of a filament fly wheel 740 of a cane of the present disclosure. Fly wheel 740 is an assembly having twin spool 750, twin spool guide 742, and brackets 730, 732. Gripper actuator cable 210 (left) and electric wire 531 (right) to power the base light are wrapped, respectively, around twin spool 750, which is mounted in the handle housing 745 (FIG. 7B). Twin spool guide 742 is shown in side and front views as indicated by the double arrow. Twin spool 750 of fly wheel 740 is shown in partially exploded view with brackets 730/732 at the bottom of FIG. 7A.

FIG. 7B is a translucent view of the upper portion of a cane of the present disclosure. Light switch 540 (FIG. 5A) provides a grounding wire at location 760, a live wire attachment at location 770 and negative wire attachment at location 780.

Figure 8A:
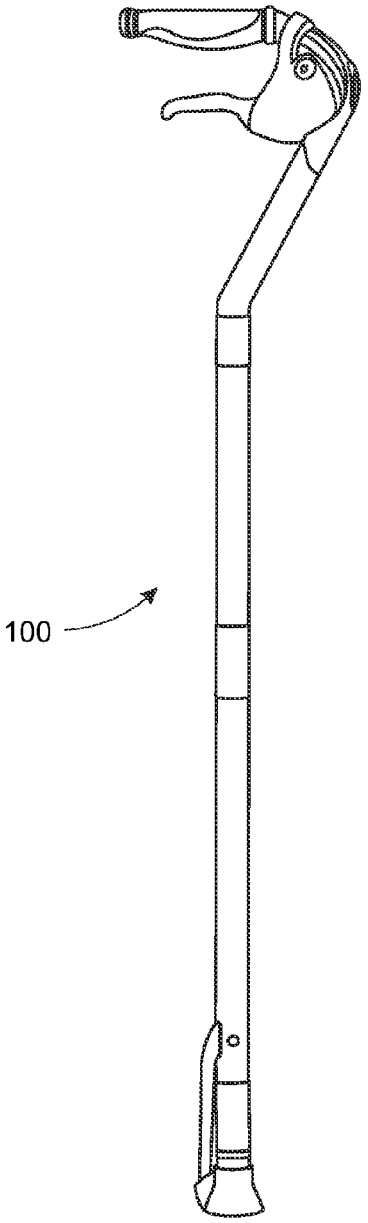
FIG. 8A is an exterior opaque side view illustration of the present cane.
Figure 8B:
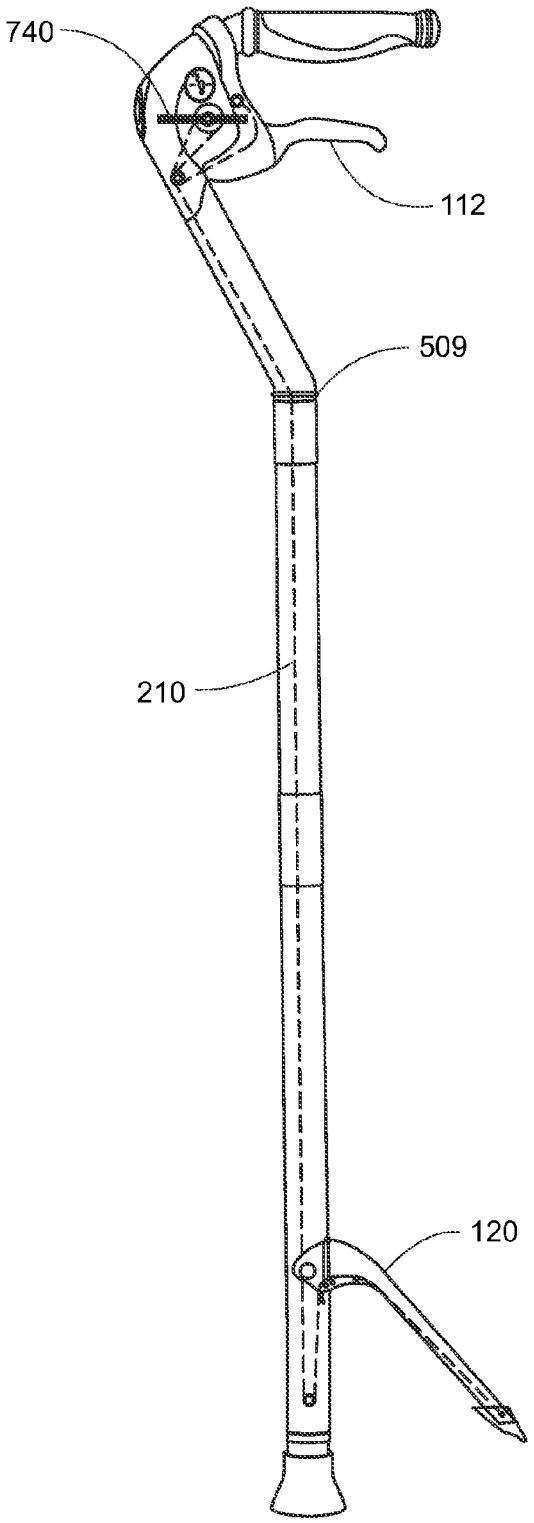
FIG. 8B is a translucent side view illustration of a gripper arm actuator cable path.

FIG. 8A-H is a diagrammatic illustration of a gripper cable and electric wire flywheel and brake assembly of a cane of the present disclosure. FIG. 8A depicts exterior opaque side view of the cane, showing the flywheel housing, gripper trigger, optional but preferred reflective strips along the vertical portion, gripper arm and base. FIG. 8B illustrates a translucent side view of cable 210 path extending from the flywheel 740 housing, through cable guides 510 and to gripper arm 120.

Figure 8C:
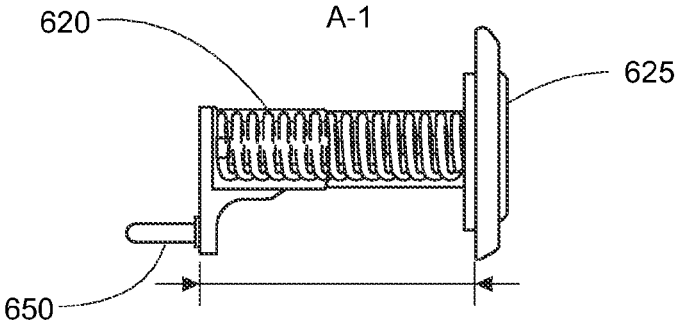
FIG. 8C is a side view illustration of the spring-biased flywheel lock mechanism in the locked position.

FIG. 8C is a side view of the spring-biased flywheel lock mechanism. Spring 620 is in fully extended position. Pin 650 engages the sprocket flywheel teeth 655 for a full braking stop of the flywheel 740.

Figure 8D:
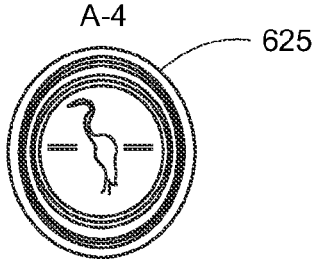
FIG. 8D is a front view illustration of a lock mechanism actuator button.

FIG. 8D is a front view of lock mechanism actuator button 625.

Figure 8E:
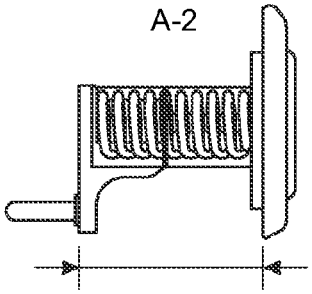
FIG. 8E is a side view of the lock mechanism of FIG. 8C in the unlocked position.

FIG. 8E is a side view of the lock mechanism of FIG. 8C in the unlocked position. Manually pressing a toggle actuator button 625 in front of the side of the flywheel housing releases pin 650 from the flywheel sprocket teeth 655 to activate the gripper arm 120 for use. Upon unlocking pin 650, cable 210 is free to unspool and gripper arm 120 extends away from the cane base to be in position to grab an object. Gripper arm is activated to grip by manually squeezing the gripper trigger 112, which causes the gripper cable 210 to retract by re-spooling around the flywheel 740. A gripped object may be released by manually releasing the trigger handle 112 to once again let the gripper cable unspool and the gripper return to the open position. To return the gripper to its stand-by position abutting the base of the cane, the trigger handle is manually squeezed to re-spool the cable and close the gripper arm against the cane base, then the lock mechanism is activated by manual pushing of the toggle button 625 to engage pin 650 with the flywheel teeth 655 to lock the gripper arm in the closed position. When the trigger handle 112 is released with the gripper arm 120 locked, gripper arm 120 does not open and the cane is restored to walking mode.

Figure 8F:
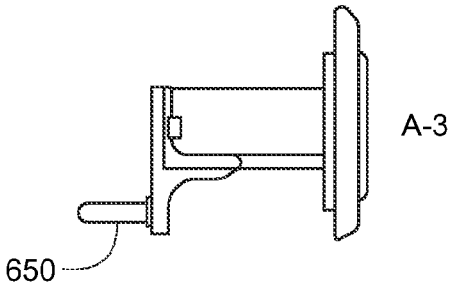
FIG. 8F is a side view diagrammatic illustration of the lock mechanism housing.

FIG. 8F is a side view diagrammatic illustration of the lock mechanism housing.

Figure 8G:
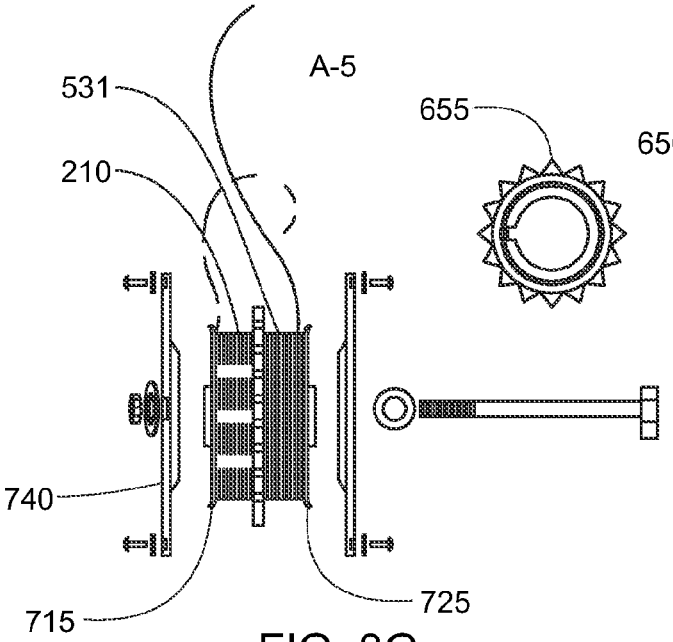
FIG. 8G is an exploded front view illustration of a dual sprocket flywheel of the present disclosure.

FIG. 8G illustrates an exploded front view of flywheel 740. Flywheel 740 is a twin flywheel sprocket assembly with spool 715 for gripper actuator cable 210 to actuate gripper arm 120 and spool 725 for electrical conductor wire 531 to actuate light sources of light bulbs 548/620. Flywheel 740 rotates forward and reverse to provide a cable extender/retractor from the hand trigger to the base end gripper rod attachment and base end light fixture attachment while keeping tension on the gripper rod cable. Extension and retraction of electrical conductor 531 is advantageous for changing the height of cane 100 to suit a particular user.

Filament 531 is the electrical conductor wire wound around spool 725 of the dual spool flywheel sprocket assembly 740. Electrical wire 531 provides power to the light fixture 620 in the base of the cane. Tension on the electrical wire is released when the flywheel is unlocked.

Figure 8H:
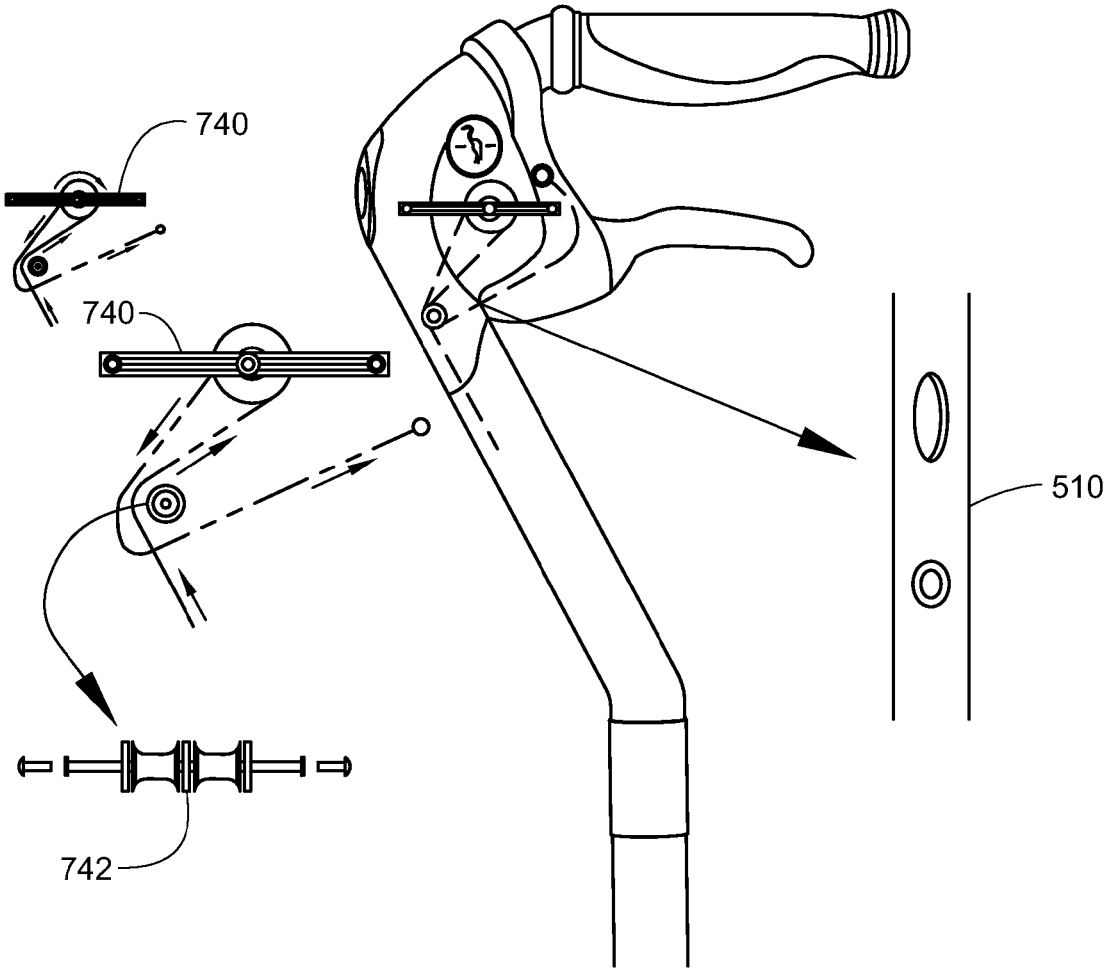
FIG. 8H is a front and side view illustration of a flywheel guide of the present disclosure.

Cable 210 is spooled around the gripper arm cable spool 715 of the flywheel sprocket assembly. The cable spool 715 is spring biased to provide or release tension to the gripper arm 120 so that the arm can be opened or closed. FIG. 8H illustrates flywheel 740 in side and front views. Each spool 715/725 of the flywheel 740 rotates independently to provide independent alignment of the electrical and gripper cables, respectively, and to maintain tension on each.

The use of a walking aid of the present disclosure provides many advantages over the prior art. The internal flywheel assembly allows the electrical cable that extends from the power supply in the handle to a lamp housed in the base of the cane to extend or retract depending on the length of the cane selected by a user. The solution is elegant because a user can conveniently turn the base lamp on with a button near the handle of the cane.

A lamp in the base of the cane is advantageous because it allows a user who is standing, or even seated, to activate the base lamp to illuminate the floor. Floor illumination is useful, for example, to find dropped medication. Light from the base lamp can illuminate under furniture.

The present walking aid provides a front facing lamp as well as the base lamp. The advantages of a front facing lamp are numerous, not the least of which is to reveal obstacles to avoid in a darkened room.

The gripper arm of the present walking cane has a "safety" lock that secures the gripper arm in position stowed against the body of the cane until the safety is released to deploy the gripper arm.

Many modifications and other embodiments of the walking cane described herein will come to mind to one skilled in the art to which this disclosure pertains having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An adjustable length walking cane comprising:

a tubular body having a top end and bottom end, and a front side;

a base portion at the bottom end;

a spring-biased gripper arm at the base portion;

a selectively actuated base lamp at the base portion;

a handle portion at the top end;

a selectively actuated front lamp attached to the front side at the top end;

a power supply connected to the front illumination source and the base illumination source;

one or more controls connected to the power supply to selectively actuate the front and base lamps independently;

a double spool sprocket flywheel assembly mounted to the body and having a first spool and a second spool;

electrical filament spooled around the first flywheel spool and connected to the power supply and the base and front illumination sources such that the tension on the electrical filament is maintained by the flywheel regardless of the length to which the cane is adjusted;

tension filament spooled around the second flywheel spool and connected to the gripper arm at the base portion such that the tension on the tension filament is maintained by the flywheel regardless of the length to which the cane is adjusted;

a selectively actuated flywheel lock to selectively lock or release the tension cable around the second spool to open the gripper arm; and a gripper arm trigger connected to the gripper arm by the tension cable to selectively open and close the gripper arm.

2. The walking cane of claim 1, further comprising one or more guide holes to maintain separation between the electrical and tension filaments.

3. The walking cane of claim 1, further comprising a handle at the handle portion of the body.

4. The walking cane of claim 1, further comprising a skid-resistant cap mounted the bottom end of the body.

5. The walking cane of claim 4, wherein the gripper arm has a bottom end and further comprising a skid-resistant cap mounted to the bottom end of the gripper arm.

6. The walking cane of claim 1, wherein the power supply is one or more batteries.

7. The walking cane of claim 1, wherein the power supply is housed in the handle portion.

8. The walking cane of claim 1, further comprising a housing for the flywheel assembly.

9. A method of using an adjustable length walking cane, the walking cane having a tubular body having a top end and bottom end, and a front side, a base portion at the bottom end, a spring biased gripper arm at the base portion, a selectively actuated lamp at the base portion, a handle portion at the top end, a selectively actuated lamp attached to the front side at the top end, a power supply connected to the front lamp and the base lamp, one or more controls connected to the power supply to selectively actuate the front and base lamps independently, a double spool sprocket flywheel assembly mounted to the body and having a first spool and a second spool, electrical filament spooled around the first flywheel spool and connected to the power supply and the base and front lamps, tension filament spooled around the second flywheel spool and connected to the gripper arm at the base portion, a selectively actuated flywheel lock to selectively lock or release the tension cable around the second spool to open the gripper arm, and a gripper arm trigger connected to the gripper arm by the tension cable to selectively close the gripper arm; the method comprising the steps of:

selectively actuating the front lamp or the base lamp using the one or more controls connected to the power supply;

selectively actuating the selectively actuated fly wheel lock to release the gripper arm;

selectively actuating the gripper arm; and selectively locking the gripper arm using the selectively actuated flywheel lock to lock the gripper arm.

* * * * *